US010244330B2

(12) United States Patent
Wu et al.

(10) Patent No.: US 10,244,330 B2
(45) Date of Patent: Mar. 26, 2019

(54) LATERAL MODE CAPACITIVE MICROPHONE WITH ACCELERATION COMPENSATION

(71) Applicants: Guanghua Wu, Dublin, CA (US); Xingshuo Lan, San Jose, CA (US); Yunlong Wang, San Ramon, CA (US)

(72) Inventors: Guanghua Wu, Dublin, CA (US); Xingshuo Lan, San Jose, CA (US); Yunlong Wang, San Ramon, CA (US)

(73) Assignee: GMEMS Technologies International Limited, Milpitas, CA (US)

( * ) Notice: Subject to any disclaimer, the term of this patent is extended or adjusted under 35 U.S.C. 154(b) by 0 days.

(21) Appl. No.: 15/623,339

(22) Filed: Jun. 14, 2017

(65) Prior Publication Data

US 2018/0192206 A1 Jul. 5, 2018

Related U.S. Application Data

(63) Continuation-in-part of application No. 15/393,831, filed on Dec. 29, 2016.

(51) Int. Cl.
*H04R 19/04* (2006.01)
*H04R 7/18* (2006.01)

(52) U.S. Cl.
CPC ..... *H04R 19/04* (2013.01); *H04R 7/18* (2013.01); *H04R 2201/003* (2013.01); *H04R 2410/07* (2013.01)

(58) Field of Classification Search
CPC ... H04R 19/005; H04R 19/04; H04R 2410/05
See application file for complete search history.

(56) References Cited

U.S. PATENT DOCUMENTS 7,545,945 B2 * 6/2009 Miles ..... H04R 19/04 381/174
8,165,323 B2 * 4/2012 Zhou ..... H01G 5/011 257/415
8,265,309 B2 * 9/2012 Zhang ..... H04R 19/005 381/171
8,755,556 B2 * 6/2014 Cohen ..... B81B 3/0021 381/176
8,995,693 B2 * 3/2015 Harney ..... H04M 1/035 381/170

(Continued)

*Primary Examiner* — Curtis A Kuntz
*Assistant Examiner* — Ryan Robinson
(74) *Attorney, Agent, or Firm* — Guosheng Wang; United States Research and Patent Firm

(57) ABSTRACT

The present invention provides a lateral microphone including a MEMS microphone. In the microphone, a movable or deflectable membrane/diaphragm moves in a lateral manner relative to the fixed backplate, instead of moving toward/from the fixed backplate. A motional sensor is used in the microphone to estimate the noise introduced from acceleration or vibration of the microphone for the purpose of compensating the microphone output through a signal subtraction operation. In an embodiment, the motional sensor is identical to the lateral microphone, except that the movable membrane in the motional sensor has air ventilation holes for lowering the movable membrane's air resistance, and making the movable membrane responsive only to acceleration or vibration of the microphone.

14 Claims, 21 Drawing Sheets

(56) References Cited

U.S. PATENT DOCUMENTS

| | | | | |
|---|---|---|---|---|
| 9,510,121 | B2 * | 11/2016 | Xu | H04R 1/326 |
| 9,611,135 | B1 * | 4/2017 | Klein | B81B 3/0059 |
| 9,674,627 | B2 * | 6/2017 | Hsu | H04R 31/006 |
| 9,728,653 | B2 * | 8/2017 | Dehe | H04R 19/005 |

* cited by examiner

LATERAL MODE CAPACITIVE MICROPHONE WITH ACCELERATION COMPENSATION

CROSS-REFERENCE TO RELATED U.S. APPLICATIONS

This application is a Continuation-in-Part of U.S. non-provisional application Ser. No. 15/393,831 filed on Dec. 29, 2016, which is incorporated herein by reference in its entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable

FIELD OF THE INVENTION

The present invention generally relates to a lateral mode capacitive microphone with acceleration compensation. The microphone of the invention may find applications in smart phones, telephones, hearing aids, public address systems for concert halls and public events, motion picture production, live and recorded audio engineering, two-way radios, megaphones, radio and television broadcasting, and in computers for recording voice, speech recognition, VoIP, and for non-acoustic purposes such as ultrasonic sensors or knock sensors, among others.

BACKGROUND OF THE INVENTION

FIG. 1A is a schematic diagram of parallel capacitive microphone in the prior art. Two thin layers 101 and 102 are placed closely in almost parallel. One of them is fixed backplate 101, and the other one is movable/deflectable membrane/diaphragm 102, which can be moved or driven by sound pressure. Diaphragm 102 acts as one plate of a capacitor, and the vibrations thereof produce changes in the distance between two layers 101 and 102, and changes in the mutual capacitance therebetween.

"Squeeze film" and "squeezed film" refer to a type of hydraulic or pneumatic damper for damping vibratory motion of a moving component with respect to a fixed component. Squeezed film damping occurs when the moving component is moving perpendicular and in close proximity to the surface of the fixed component (e.g., between approximately 2 and 50 micrometers). The squeezed film effect results from compressing and expanding the fluid (e.g., a gas or liquid) trapped in the space between the moving plate and the solid surface. The fluid has a high resistance, and damps the motion of the moving component as the fluid flows through the space between the moving plate and the solid surface.

In capacitive microphones as shown in FIG. 1A, squeeze film damping occurs when two layers 101 and 102 are in close proximity to each other with air disposed between them. The layers 101 and 102 are positioned so close together (e.g. within 5 μm) that air can be "squeezed" and "stretched" to slow movement of membrane/diaphragm 102. As the gap between layers 101 and 102 shrinks, air must flow out of that region. The flow viscosity of air, therefore, gives rise to a force that resists the motion of moving membrane/diaphragm 101. Squeeze film damping is significant when membrane/diaphragm 101 has a large surface area to gap length ratio. Such squeeze film damping between the two layers 101 and 102 becomes a mechanical noise source, which is the dominating factor among all noise sources in the entire microphone structure.

Co-pending U.S. application Ser. No. 15/393,831 to the same assignee, which is incorporated herein by reference, teaches a so-called lateral mode microphone in which the movable membrane/diaphragm does not move into the fixed backplate, and the squeeze film damping is substantially avoided. An embodiment of the lateral mode microphone is shown in FIG. 1B First electrical conductor 201 is stationary, and has a function similar to the fixed backplate in the prior art. A large flat area of second electrical conductor 202, similar to movable/deflectable membrane/diaphragm 102 in FIG. 1A, receives acoustic pressure and moves up and down along the primary direction, which is perpendicular to the flat area. However, conductors 201 and 202 are configured in a side-by-side spatial relationship, not one above another. As one "plate" of the capacitor, conductor 202 does not move toward and from conductor 201. Instead, conductor 202 laterally moves over, or "glides" over, conductor 201, producing changes in the overlapped area between 201 and 202, and therefore varying the mutual capacitance therebetween. A capacitive microphone based on such a relative movement between conductors 201 and 202 is called lateral mode capacitive microphone.

However, such a lateral mode capacitive microphone suffers a problem. An acceleration of the microphone may affect the accuracy of sound detection. An acceleration of 1 G on the direction that is normal to the flat area of conductor 202 (or membrane 202) causes a signal to be detected, whose value may be 13% of 1 Pa sound pressure. Signal to Acceleration Ratio (SAR) may be used to define this effect. For example, the SAR for a single slot design structure disclosed in the co-pending U.S. application Ser. No. 15/393,831 can be around 7.6, which is much smaller than the typical SAP. 70-100 for a conventional MEMS microphone. A microphone with low SAR will suffer from inaccurate signal detection when the microphone vibrates at low frequency. For example, if the microphone, or a device using, such a microphone (e.g. a cellphone), is being used in a running automobile, the shake or vibration of the device along the automobile is actually an acceleration applied on membrane 202 and may be "misread" as a sound signal.

Advantageously, the present invention provides an improved lateral mode capacitive microphone, in which the low SAR effect is compensated.

SUMMARY OF THE INVENTION

In various embodiments, the present invention utilizes a reference moving membrane that can detect substantially only the acceleration signal. The measured acceleration signal can then be used to cancel out the component of actual acceleration signal in the total ("gross") signal as measured by the lateral microphone in real-time, through a signal subtraction operation.

The present invention provides a capacitive microphone comprising three components: a first electrical working conductor, a second electrical working conductor, and a motional sensor. The two working conductors are configured to have a relative spatial relationship therebetween, and a mutual capacitance exists between the two working conductors. While an acoustic pressure impacting upon one or two of the two working conductors along a range of impacting directions in 3D space can cause a variation Va of the mutual capacitance, an acceleration of the capacitive microphone can cause a variation Vm of the mutual capacitance as a noise. The total ("gross") signal as measured by the two conductors is defined as Vtotal=Va+Vm. Mainly in response to the same acceleration, the motional sensor can also give a capacitance output Vms, which is used to compensate or correct Vtotal in real-time.

The relationship between the two working, conductors is defined in the following. Variation. Va reaches its maximal value, when an acoustic pressure with a given strength impacts upon one or two of the two working conductors along one direction among said range of impacting directions. This direction is herein defined as the primary working direction. The first electrical working conductor has a first working projection along said primary working direction on a conceptual working plane that is perpendicular to said primary working direction, and the second electrical working conductor has a second working projection along said primary working direction on the conceptual working plane. The first working projection and the second working projection have a shortest working distance Dwmin therebetween. Dwmin remains greater than zero regardless that one or two of said two working conductors is (are) impacted by an acoustic pressure along said primary working direction or not. In other words, the first working projection and the second working projection do not overlap with each other at all on the conceptual working plane.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form in order to avoid unnecessarily obscuring the present invention Other parts may be omitted or merely suggested.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

Figure 2A:
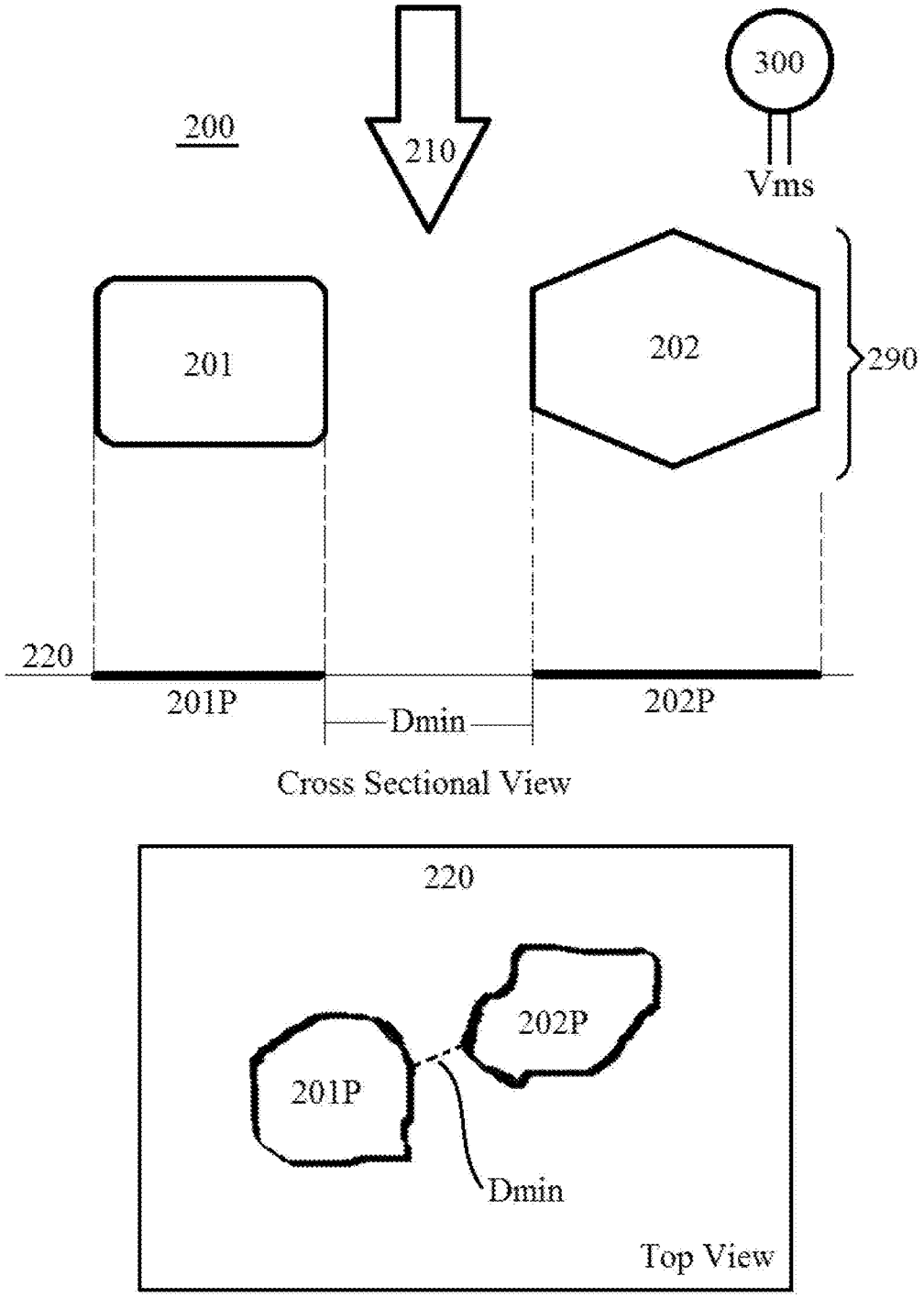
FIG. 2A schematically shows a lateral mode capacitive microphone in accordance with an exemplary embodiment of the present invention.

FIG. 2A illustrates a capacitive microphone 200 such as a MEMS microphone according to various embodiments of the invention. Microphone 200 includes a functional device 290, and a motional sensor 300. In functional device 290, a first electrical working conductor 201 and a second electrical working conductor 202 are configured to have a relative spatial relationship therebetween so that a mutual capacitance can exist between them. Conductors 201 and 202 are independently of each other made of polysilicon, gold, silver, nickel, aluminum, copper, chromium, titanium, tungsten, and platinum. The relative spatial relationship as well as the mutual capacitance can both be varied by an acoustic pressure impacting upon conductors 201 and/or 202.

Figure 3:
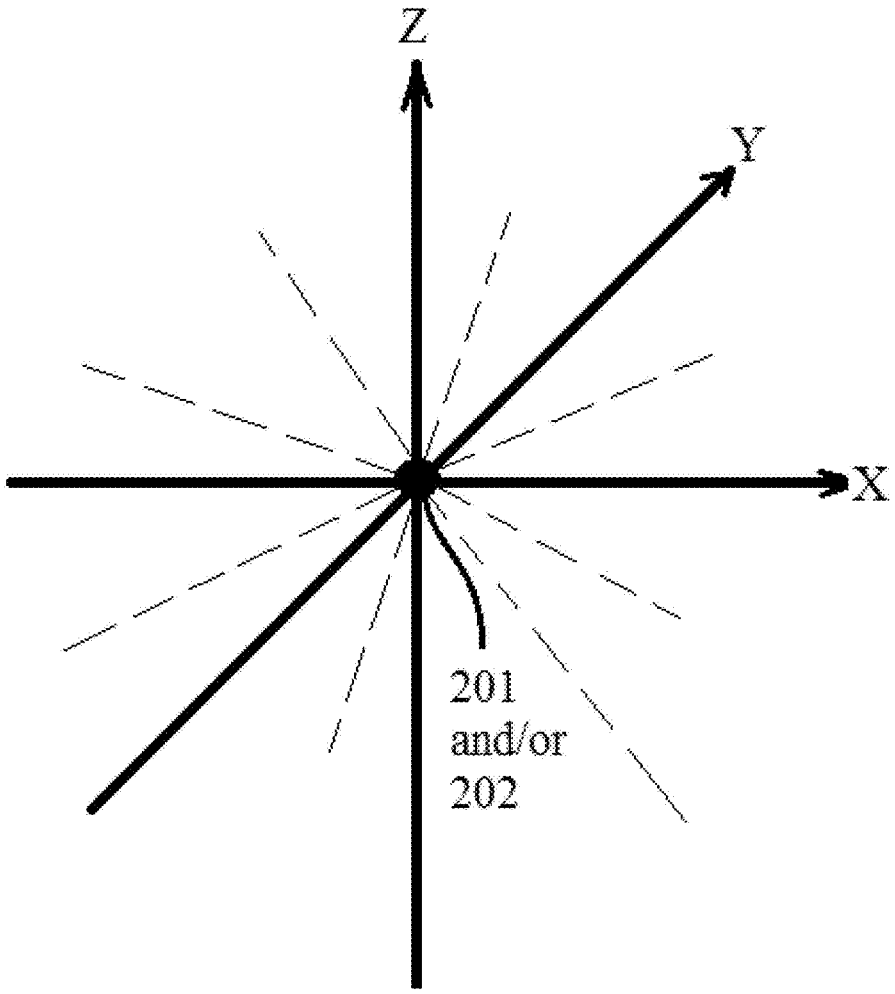
FIG. 3 illustrates acoustic pressures impacting a microphone along a range of directions.

As shown in FIG. 3, an acoustic pressure as represented by dotted lines may impact 201 and/or 202 along a range of impacting directions in 3D space. While the acoustic pressure can cause a variation Va of the mutual capacitance, an acceleration of the capacitive microphone 200 can also cause a variation Vm of the mutual capacitance as a noise. The total ("gross") signal as measured by functional device 290 is defined as Vtotal=Va+Vm. Within microphone 200, a motional sensor 300 is designed to estimate Vm only, and to output a capacitance Vms, which is used to compensate Vtotal in real-time, or cancel off Vm component in Vtotal as accurately as possible.

Figure 4:
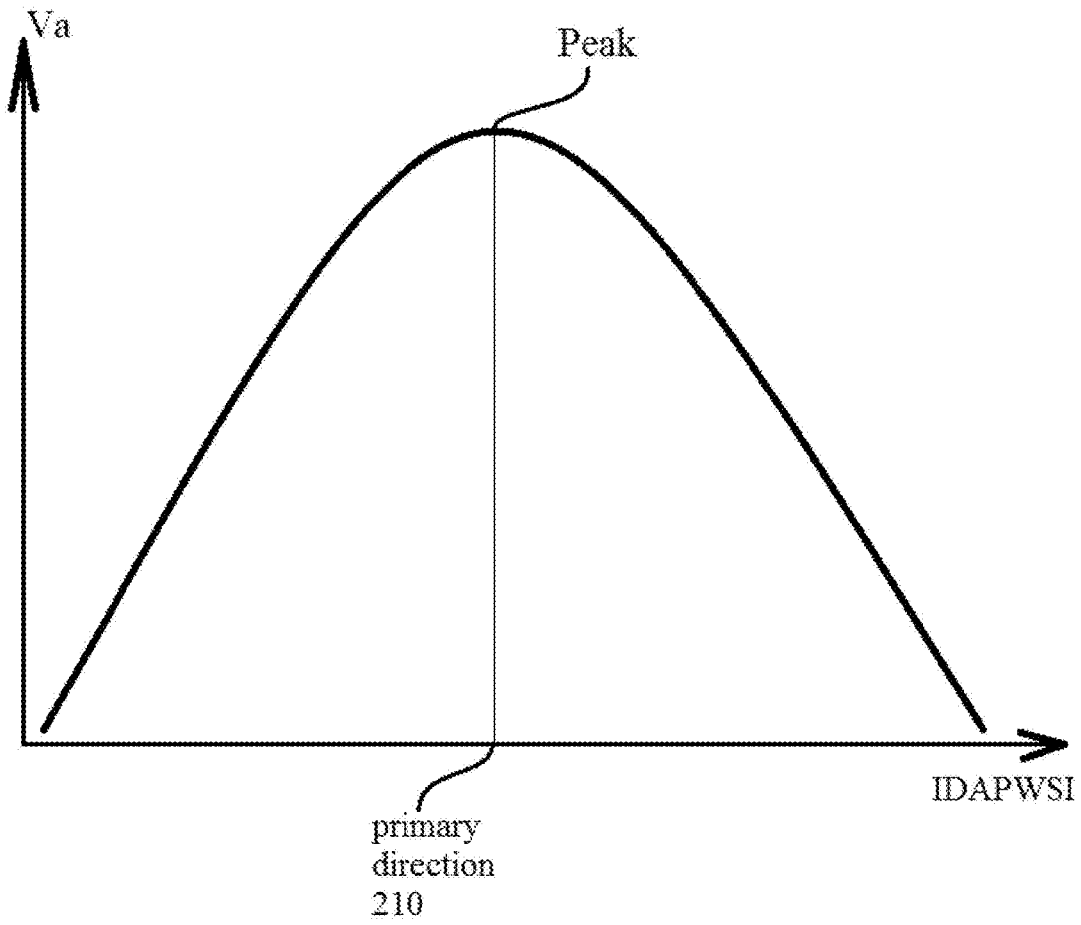
FIG. 4 illustrates the methodology on how to determine the primary working direction for the internal components in a microphone in accordance with an exemplary embodiment of the present invention.

Given the same strength/intensity of acoustic pressure, the mutual capacitance can be varied the most (or maximally varied) by an acoustic pressure impacting upon conductor 201 and/or conductor 202 along a certain direction among the above range of impacting directions as shown in FIG. 3. The variation of mutual capacitance Va caused by various impacting directions of acoustic pressure from 3D space with same intensity (IDAPWSI) is conceptually plotted in FIG. 4. A primary working direction is defined as the impacting direction that generates the peak value of Va, and is labeled as direction 210 in FIG. 2A. It should be appreciated that, given the same strength/intensity of acoustic pressure, the relative spatial relationship can also be varied the most (or maximally varied) by an acoustic pressure impacting upon conductor 201 and/or conductor 202 along a certain direction X among the range of impacting directions as shown in FIG. 3. Direction X may be the same as, or different from, the primary working direction 210 as defined above. In some embodiments of the invention, the primary working, direction may be alternatively defined as the direction X.

Referring back to FIG. 2A, conductor 201 has a first working projection 201P along direction 210 on a conceptual working plane 220 that is perpendicular to direction 210. Similarly, conductor 202 has a second working projection 202P along direction 210 on plan 220. Projection 201P and projection 202P have a shortest working distance Dmin therebetween. In the present invention, Dmin may be constant or variable, but it is always greater than zero, no matter conductor 201 and/or conductor 202 are/is being impacted by an acoustic pressure along direction 210 or not.

Figure 2B:
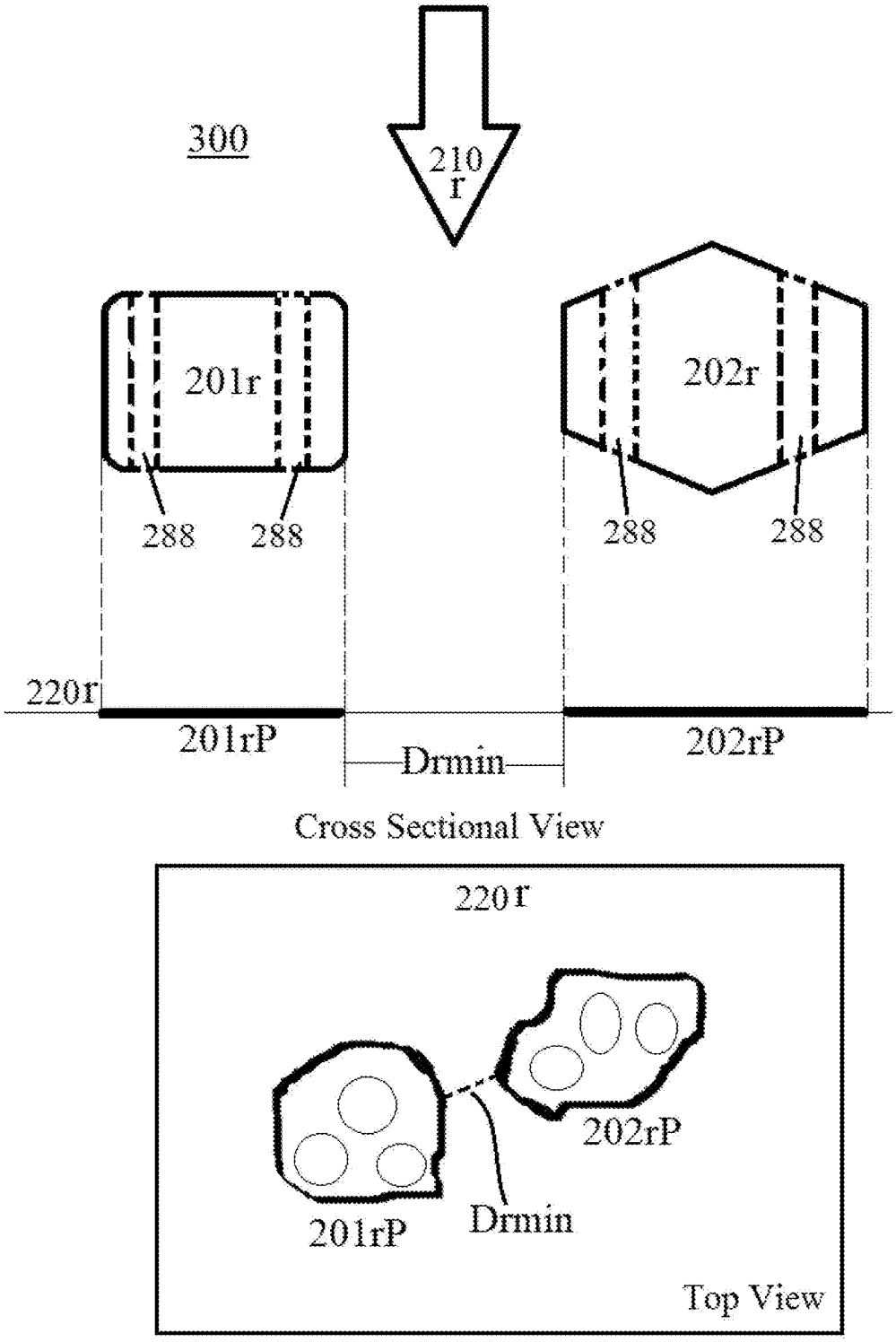
FIG. 2B illustrates a motional sensor in the lateral mode capacitive microphone in accordance with an exemplary embodiment of the present invention.

FIG. 2B schematically illustrates an exemplary motional sensor 300 in the lateral mode capacitive microphone 200. Motional sensor 300 is almost identical to functional device 290 as shown in FIG. 2A. By "almost identical", it means that the only difference between device 290 and sensor 300 is that the resistance $R_{fd}$ of conductor 201 and/or conductor 202 against an impacting acoustic pressure is much greater than the resistance $R_{ms}$, of the counterparts of conductor 201 and/or conductor 202 in motional sensor 300 (i.e conductors 201*r* and 202*r*) against the same impacting acoustic pressure. Therefore, reference numbers in FIG. 2B with a suffix "r" such as 201*r*, 202*r*, 210*r*, 220*r*, 201*r*P, 202*r*P, and Dmin have identical meanings (mutatis mutandis) as those in FIG. 2A such as 201, 202, 210, 220, 201P, 202P, and Dmin, and will not be explained here again for conciseness. A term "reference" instead of "working" is used in the nomenclature for motional sensor 300 to distinguish it from functional device 290. For example, the counterpart of the first electrical working conductor 201 in functional device 290 is named as "the first electrical reference conductor 201*r*" in motional sensor 300.

An acoustic pressure can impact, but impact much less than that against functional device 290 as shown in FIG. 2A, upon one or both of conductors 201*r* and 202*r*, along a range of impacting reference directions in 3D space, but it can still cause a variation Va' of the mutual capacitance. An acceleration or vibration of the capacitive microphone 200 can also cause a variation Vm' of the mutual capacitance, and Vms=Va'+Vm'. A corrected output Vct=Vtotal−Vms is used as the output of the microphone 200. In preferred embodiments, motional sensor 300 is identical to functional device 290 as shown in FIG. 2A with only one difference, i.e., conductors 201*r* and/or 202*r* have much less air resistance, or very little response to the impacting acoustic pressure. As a result, Va' has a minimal value and is near zero, Vm' is close to Vm, and therefore Vms is close to V'm. In an embodiment, conductors 201*r* and/or 202*r* have air ventilation device(s) 288 for air to go through them with reduced impacting force. In various embodiments, Va'<20% Va, and 80% Vm<Vm'<Vm. For example, Va'=3.5% Va, and Vm'=96.9% Vm.

Figure 1A:
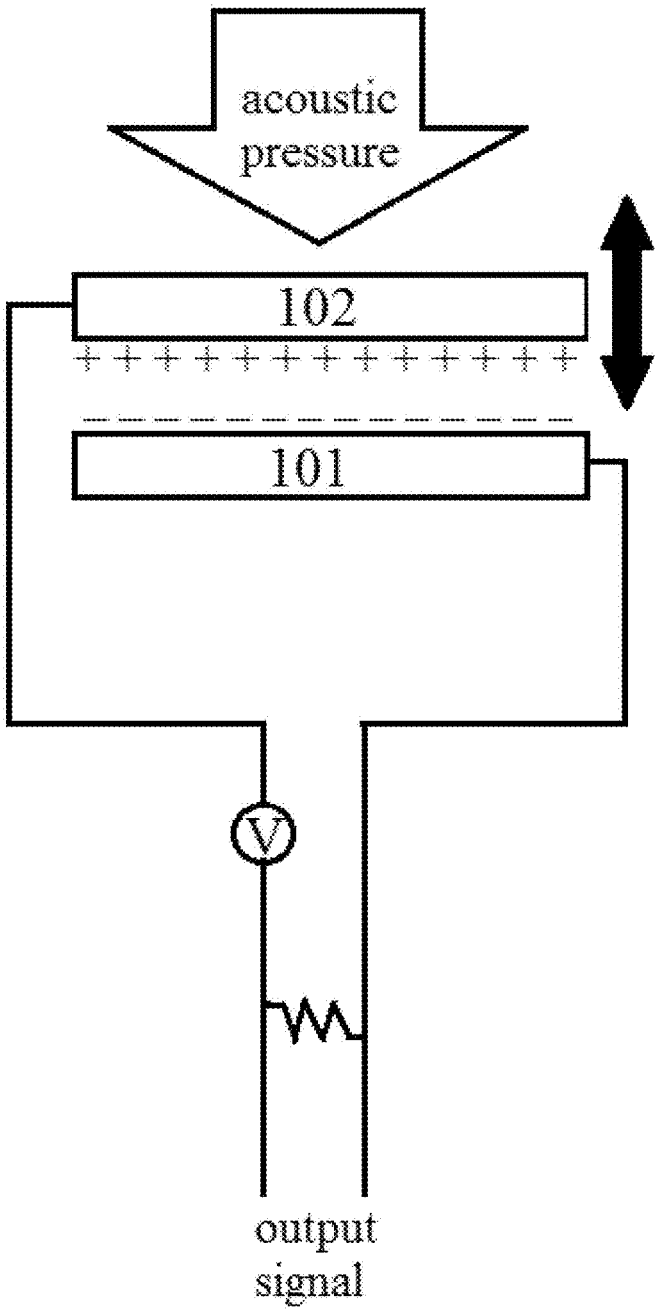
(Prior Art) Figure 1A
FIG. 1A shows a conventional capacitive microphone in the prior art.
Figure 1B:
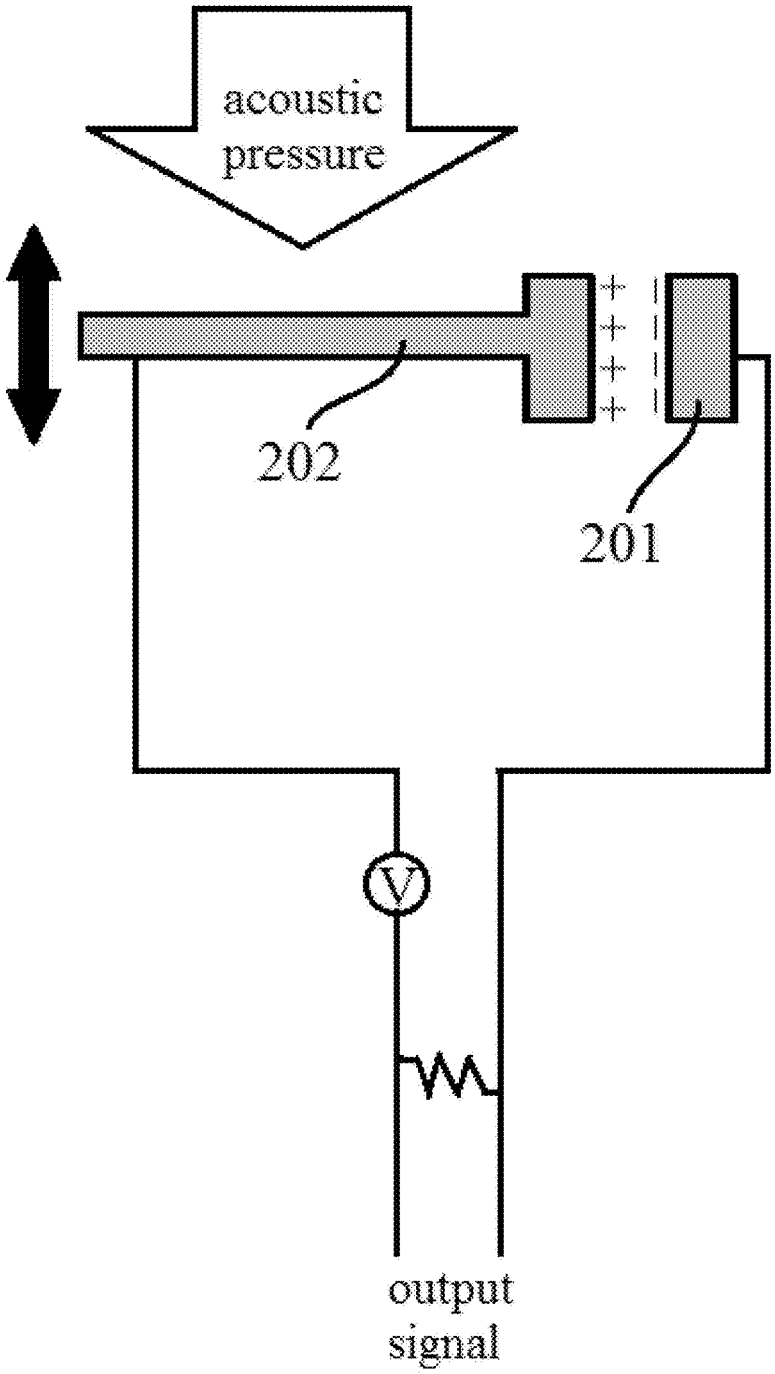
FIG. 1B illustrates a lateral mode capacitive microphone in a co-pending U.S. application filed by the same Applicants.
Figure 2C:
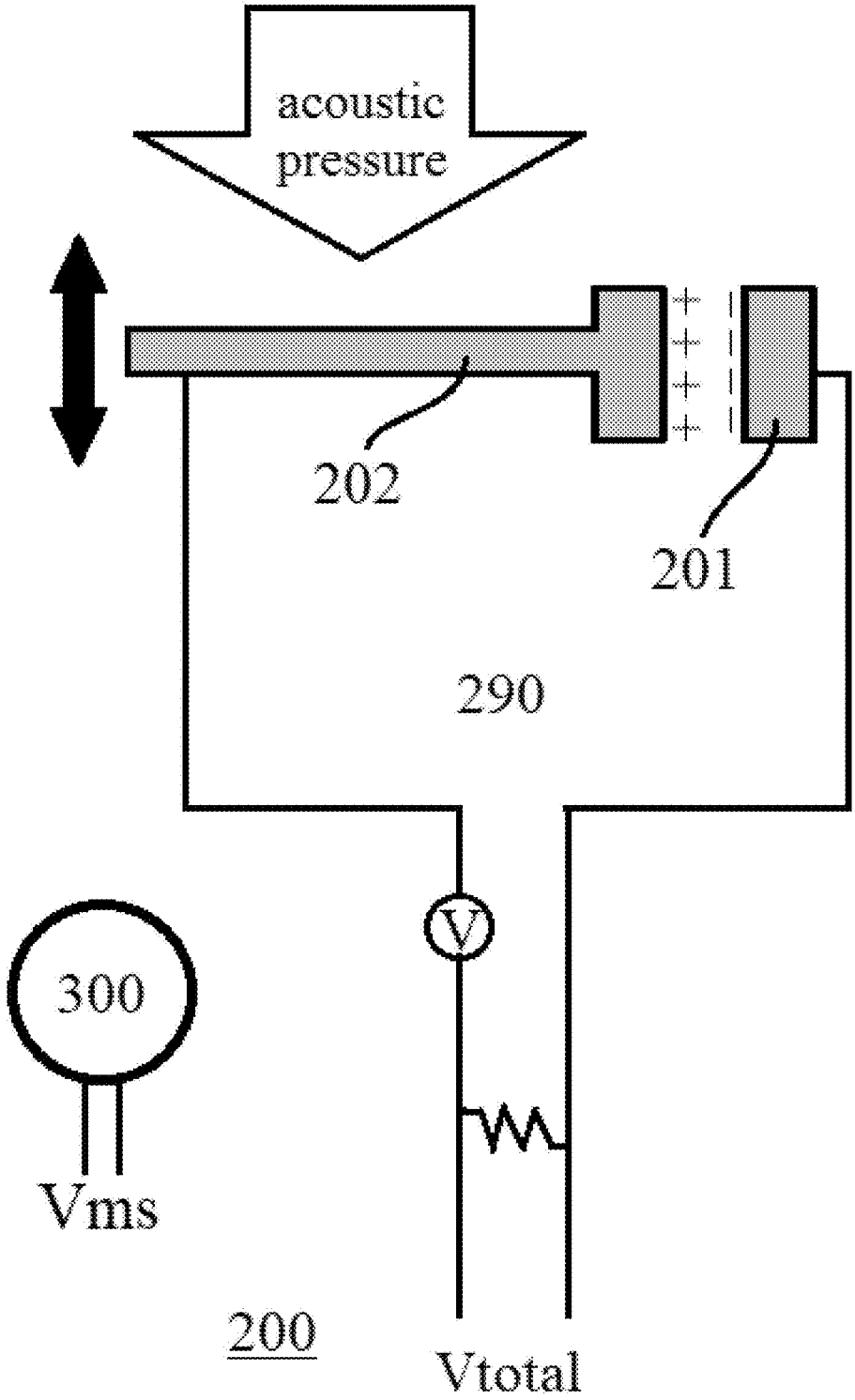
FIG. 2C illustrates a lateral mode capacitive microphone in accordance with an exemplary embodiment of the present invention.

FIG. 2C illustrates a more specific but still exemplary embodiment of the microphone in FIG. 2A. Microphone 200 includes a functional device 290 and a motional sensor 300. Working conductor 201 is stationary, and has a function similar to the fixed backplate in the prior art A large flat area of working conductor 202, or working membrane 202, similar to movable/deflectable membrane/diaphragm 102 in FIG. 1A, receives acoustic pressure and moves up and down along the primary working direction, which is perpendicular to the large flat area. However, conductors 201 and 202 are configured in a side-by-side spatial relationship, unlike the stack configuration shown in FIG. 1A. As one "plate" of the capacitor, i.e. conductor 202, does not move mainly toward and from conductor 201. Instead, conductor 202 mainly moves laterally over, or "glides" over, conductor 201, producing changes in the overlapped area between 201 and 202, and therefore varying the mutual capacitance therebetween. As described in co-pending U.S. application Ser. No. 15/393,831, capacitive microphone 200 based on such a relative movement between conductors 201 and 202 is called lateral mode capacitive microphone, or simply lateral microphone.

Figure 2D:
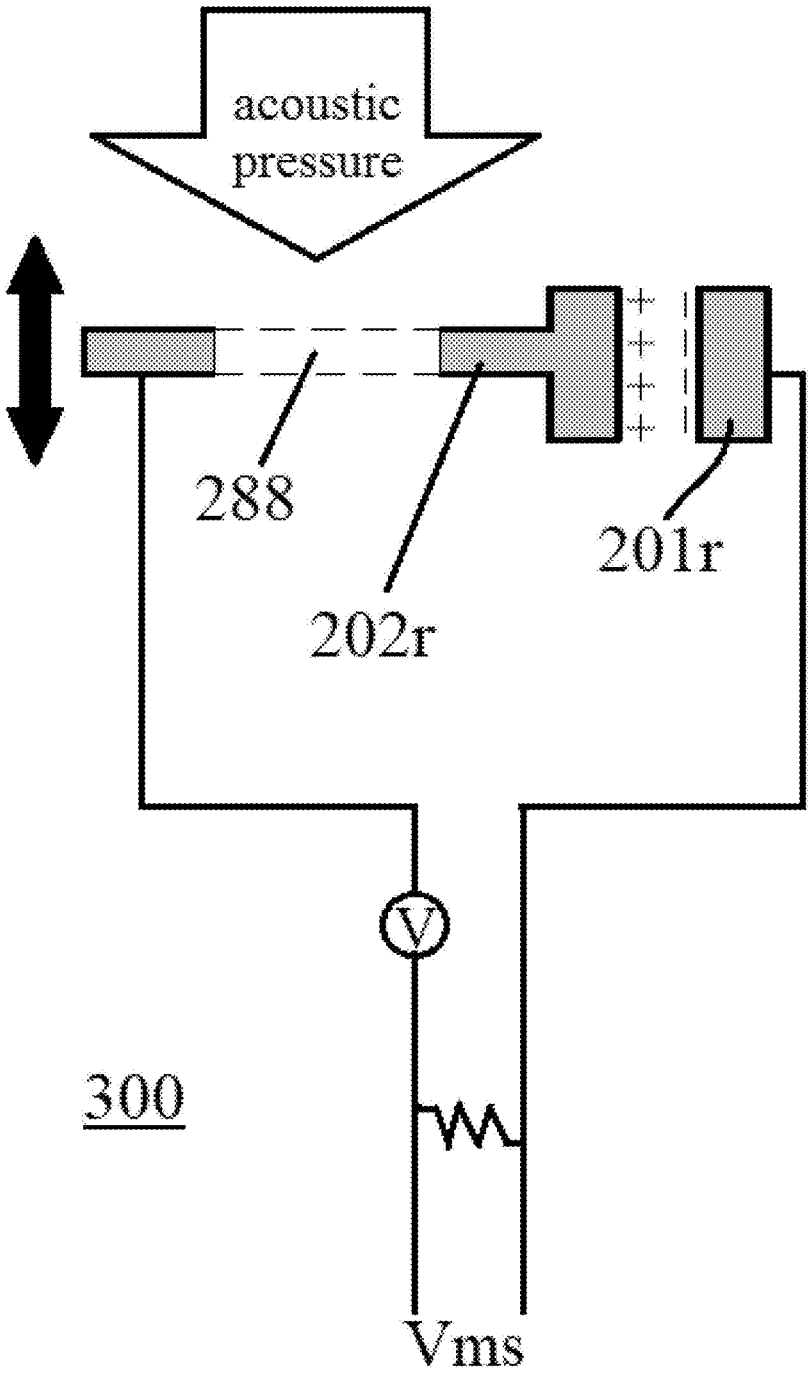
FIG. 2D illustrates a motional sensor in the lateral mode capacitive microphone in accordance with an exemplary embodiment of the present invention.

FIG. 2D schematically illustrates a motional sensor 300 in the lateral microphone 200. Motional sensor 300 may be identical to functional device 290 as shown in FIG. 2C except that movable/deflectable membrane/diaphragm 202*r*, or reference conductor/membrane 202*r*, has less air resistance than the working membrane 202. For example, reference membrane 202*r* may have one or more openings 288 thereon for air ventilation and reducing air resistance, while working membrane 202 has no such opening(s) or has less opening(s). As a result, reference membrane 202*r* receives little acoustic pressure, and moves up and down mainly in response to the acceleration or vibration of the microphone 200.

Figure 5A:
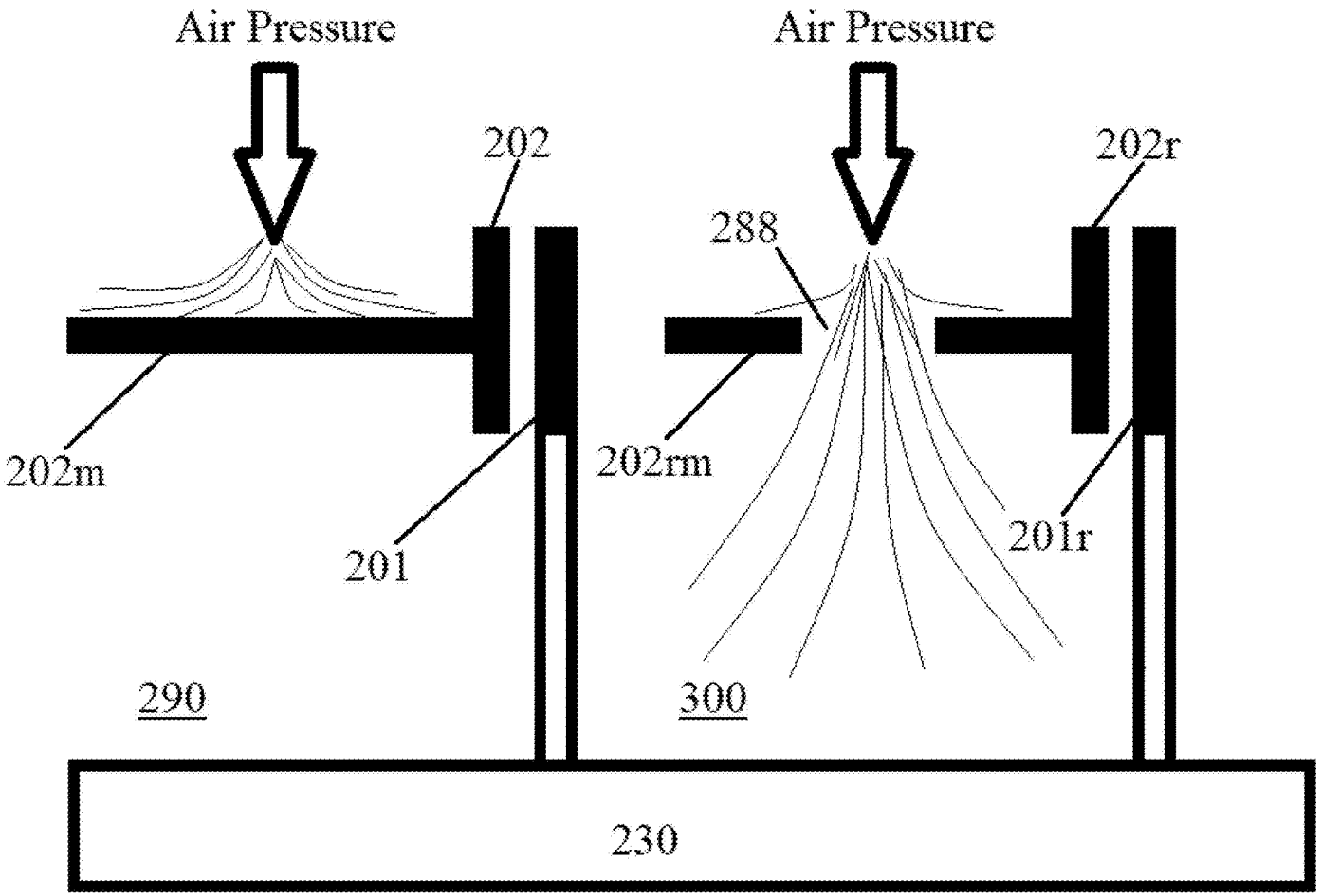
FIG. 5A schematically shows a MEMS capacitive microphone in accordance with an exemplary embodiment of the present invention.

FIG. 5A illustrates a more specific embodiment of a lateral microphone 200, in which identical conductors 201 and 201*r* are fixed relative to a substrate 230. Conductor 202 comprises a working membrane 202*m* that is movable relative to the substrate 230, and the primary working direction is perpendicular to the working membrane 202*m* plane. Reference conductor 202*r* comprises a reference membrane 202*rm* that is also movable relative to the substrate 230, and the primary reference direction is perpendicular to the reference membrane 202*rm* plane. Working membrane 202*m* plane and reference membrane 202*rm* plane are in parallel with each other. Conductors 202 and 202*r* are identical except that the reference membrane 202*rm* has less air resistance than the working membrane 202*m*. For example, reference membrane 202*rm* may have one or more openings 288 thereon for air ventilation, but the working membrane 202*m* has none.

In exemplary embodiments of the invention, the lateral microphone 200 may be a MEMS (Microelectromechanical System) microphone, AKA chip/silicon microphone. Typically, a pressure-sensitive diaphragm is etched directly into a silicon wafer by MEMS processing techniques, and is usually accompanied with integrated preamplifier. For a digital MEMS microphone, it may include built in analog-to-digital converter (ADC) circuits on the same CMOS chip making the chip a digital microphone and so more readily integrated with digital products.

Figure 5B:
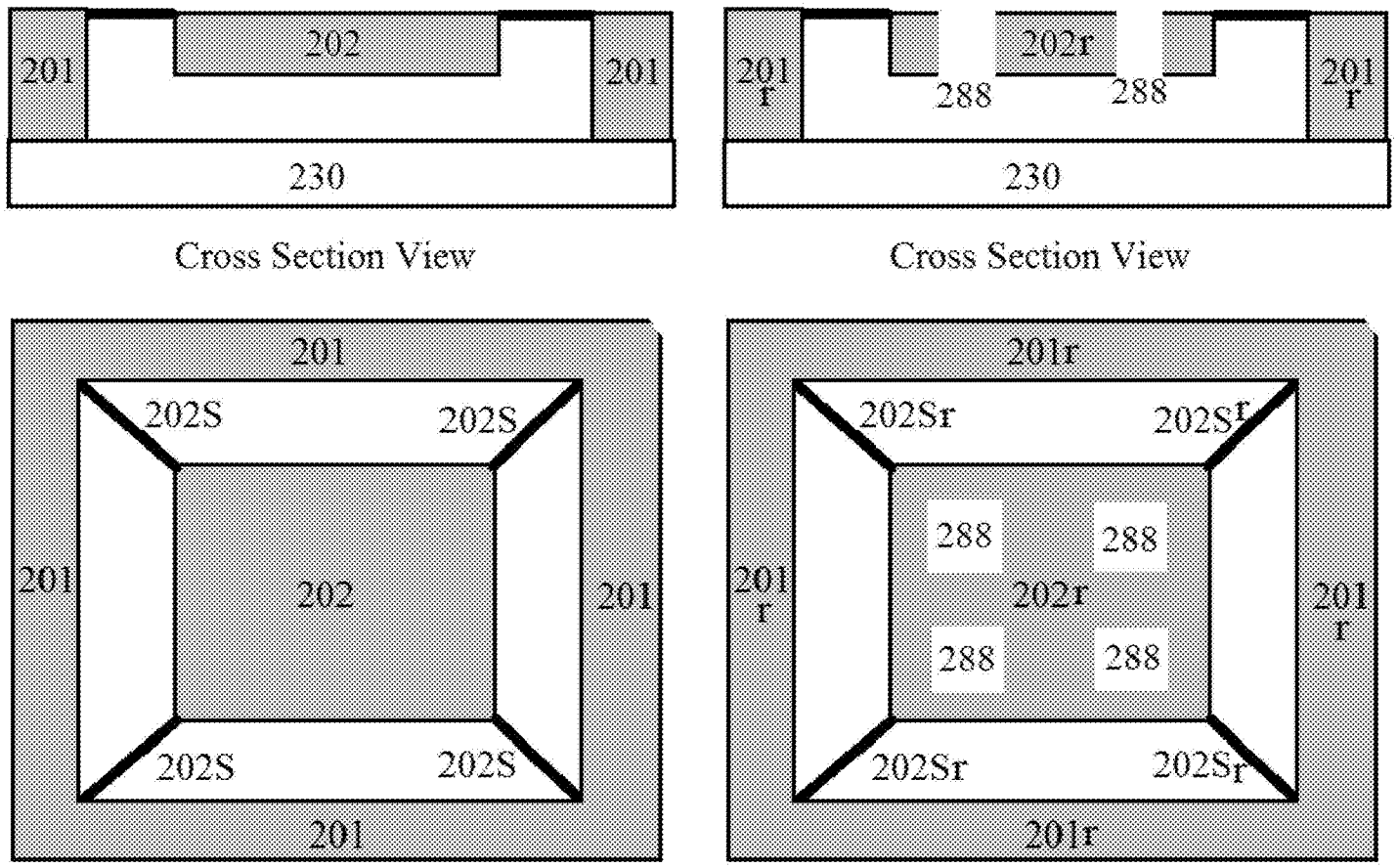
FIG. 5B schematically shows a MEMS capacitive microphone in accordance with an exemplary embodiment of the present invention.

In an embodiment as shown in FIG. 5B, capacitive microphone 200 may include a substrate 230 such as silicon, on which both functional device 290 and motional sensor 300 are fabricated. The substrate 230 can be viewed as the conceptual plane 220/220*r*. Conductor 201/201*r* and conductor 202/202*r* may be constructed above the substrate 230 side-by-side. Alternatively, conductor 201/201*r* may be surrounding conductor 202/202*r*, as shown in FIG. 5B. In an exemplary embodiment, conductor 201/201*r* is fixed to the substrate 230. On the other hand, conductor 202/202*r* may be a membrane that is movable relative to substrate 230. The primary working/reference direction may be perpendicular to the membrane plane of 202/202*r*. Movable membrane 202/202*r* may be attached to the substrate 230 via three or more working suspensions 202S/202Sr such as four working suspensions 202S/202Sr extending from four corners of 202/202*r*. Each of the suspension 202S/202Sr may comprise folded and symmetrical cantilevers (not shown). However, reference membrane 202*r* has air ventilation device(s) such as four square openings or holes 288, and working membrane 202 does not.

Figure 6:
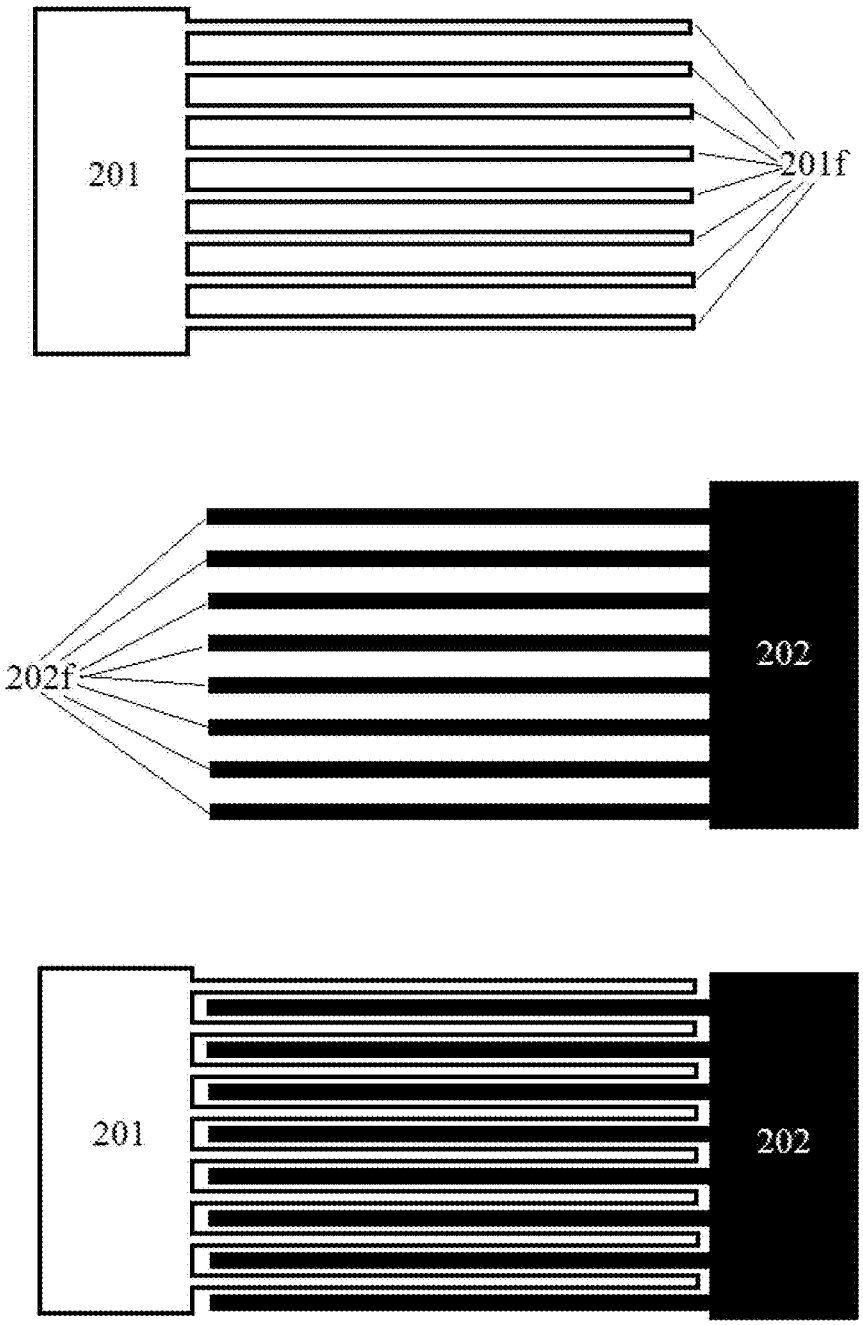
FIG. 6 illustrates the first/second electrical conductors having a comb finger configuration in accordance with an exemplary embodiment of the present invention.

In functional device 290 as shown in FIG. 6, working conductor 201 comprises a first set of working comb fingers 201*f* that is fixed to substrate 230. The movable membrane, i.e. second conductor 202, comprises a second set of working comb fingers 202*f* around the peripheral region of the membrane 202. The two sets of comb fingers 201*f* and 202*f* are interleaved into each other. The second set of comb fingers 202*f* is movable along the primary direction, which is perpendicular to the membrane plane 202, relative to the first set of comb fingers 201*f*. As such, the resistance from air located within the gap between the membrane 202 and the substrate is lowered, for example, 25 times lower squeeze film damping. In a preferred embodiment, comb fingers 201*f* and comb fingers 202*f* have identical shape and dimension. Motional device 300 is identical to functional device 290 regarding comb fingers 201*f*/201*fr* (not shown) and comb fingers 202*f*/202*fr* (not shown), and the description thereof is omitted.

Figure 7:
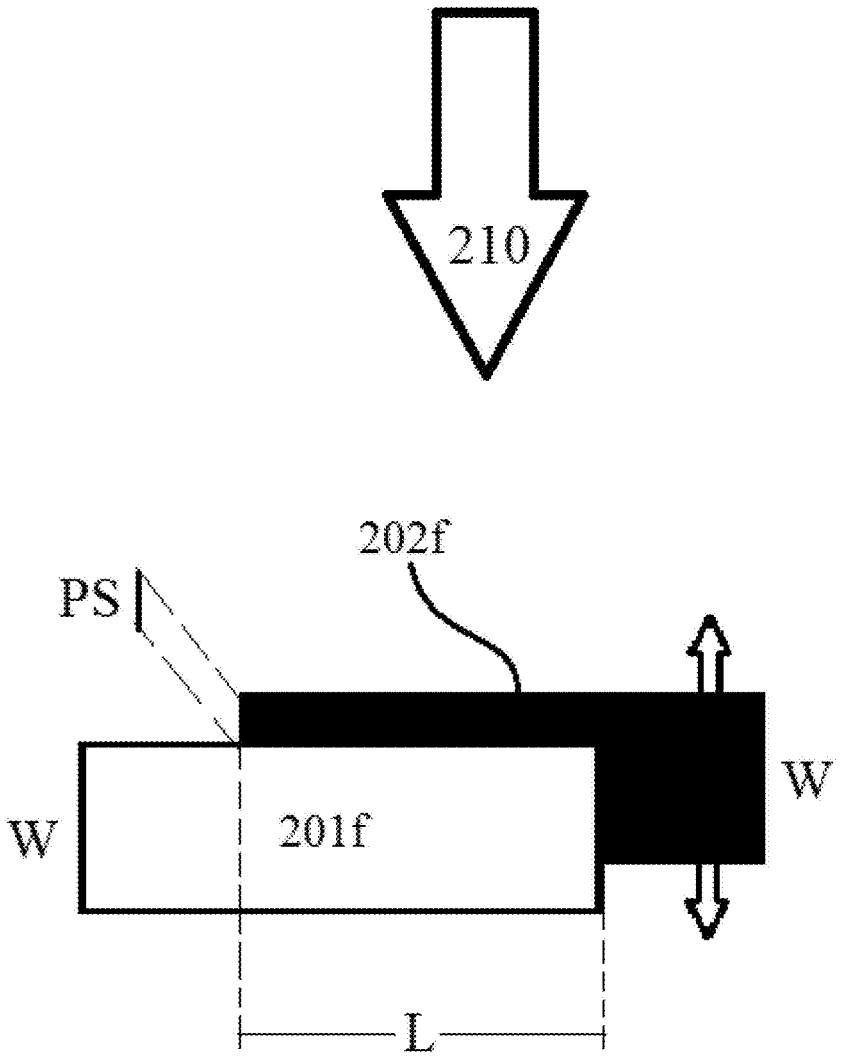
FIG. 7 depicts the spatial relationship between two comb fingers of FIG. 6 in accordance with an exemplary embodiment of the present invention.

As shown in FIG. 7, each comb finger in functional device 290 has a same width W measured along the primary working direction 210, and comb fingers 201*f* and comb fingers 202*f* have a positional shift PS along the primary working direction 210, in the absence of vibration caused by sound wave. For example, the positional shift PS along direction 210 may be one third of the width W, PS=⅓ W. In other words, comb fingers 201*f* and comb fingers 202*f* have an overlap of ⅔ W along direction 210, in the absence of vibration caused by sound wave. Motional device 300 is identical to functional device 290 regarding width Wr, positional shift PSr, and the relationship between them, and the description thereof is omitted.

Referring to FIGS. 6 and 7, working comb fingers 201*f* are fixed on an anchor, and working comb fingers 202*f* are integrated with membrane-shaped working conductor 202 (or working membrane 202), When membrane 202 vibrates due to sound wave, fingers 202*f* move together with membrane 202. The overlap area between two neighboring fingers 201*f* and 202*f* changes along with this movement, so does the capacitance between them. Eventually, a capacitance change signal is detected. In contrast, reference membrane 202 (not shown) is designed to vibrate mainly in response to acceleration, shaking, or vibration of the microphone 200, and not mainly in response to an impacting sound wave.

Figure 8A:
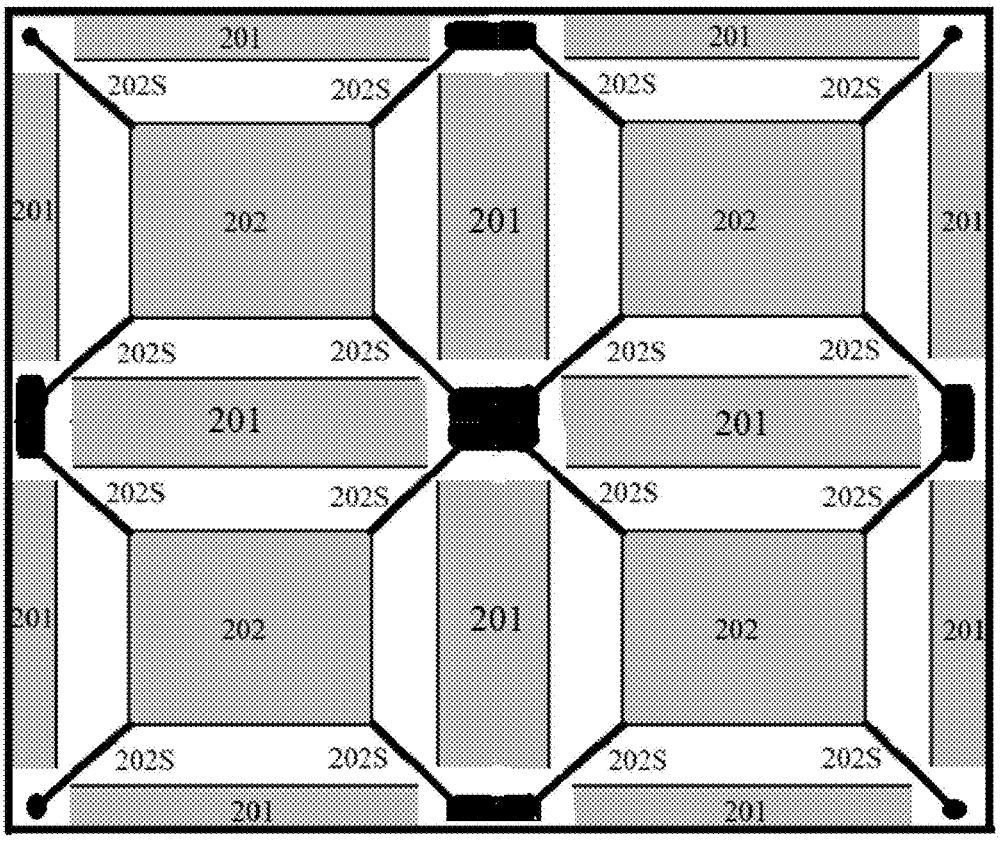
FIG. 8A illustrates a functional device including four identical movable working membranes arranged in a 2×2 array configuration in a co-pending U.S. application filed by the same Applicants.
Figure 8B:
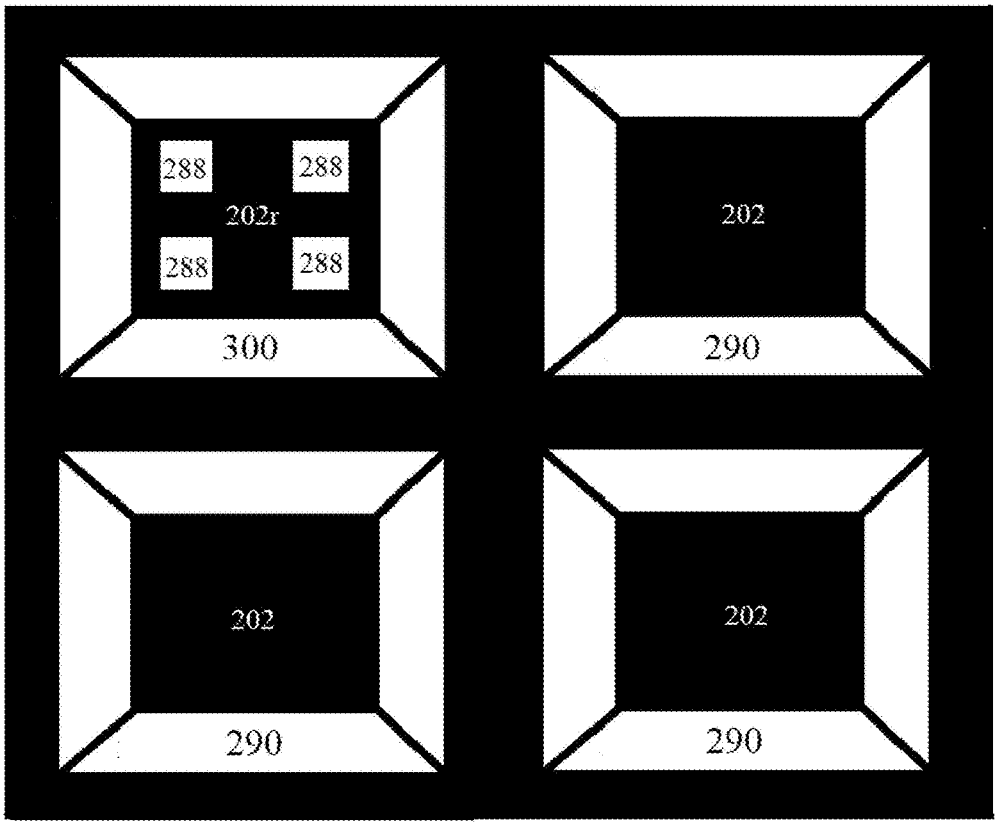
FIG. 8B shows a functional device including one reference membrane and three movable working membranes arranged in a 2×2 array configuration in accordance with an exemplary embodiment of the present invention.
Figure 8C:
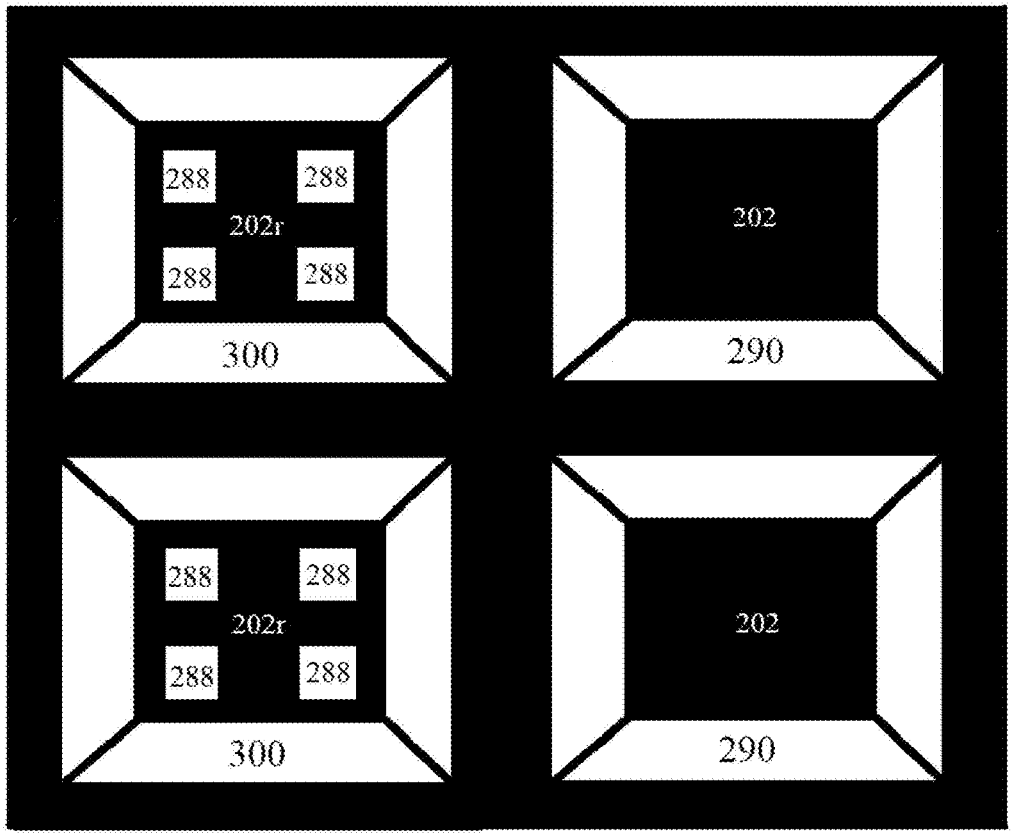
FIG. 8C shows a functional device including two reference membranes and two movable working membranes arranged in a 2×2 array configuration in accordance with an exemplary embodiment of the present invention.
Figure 8D:
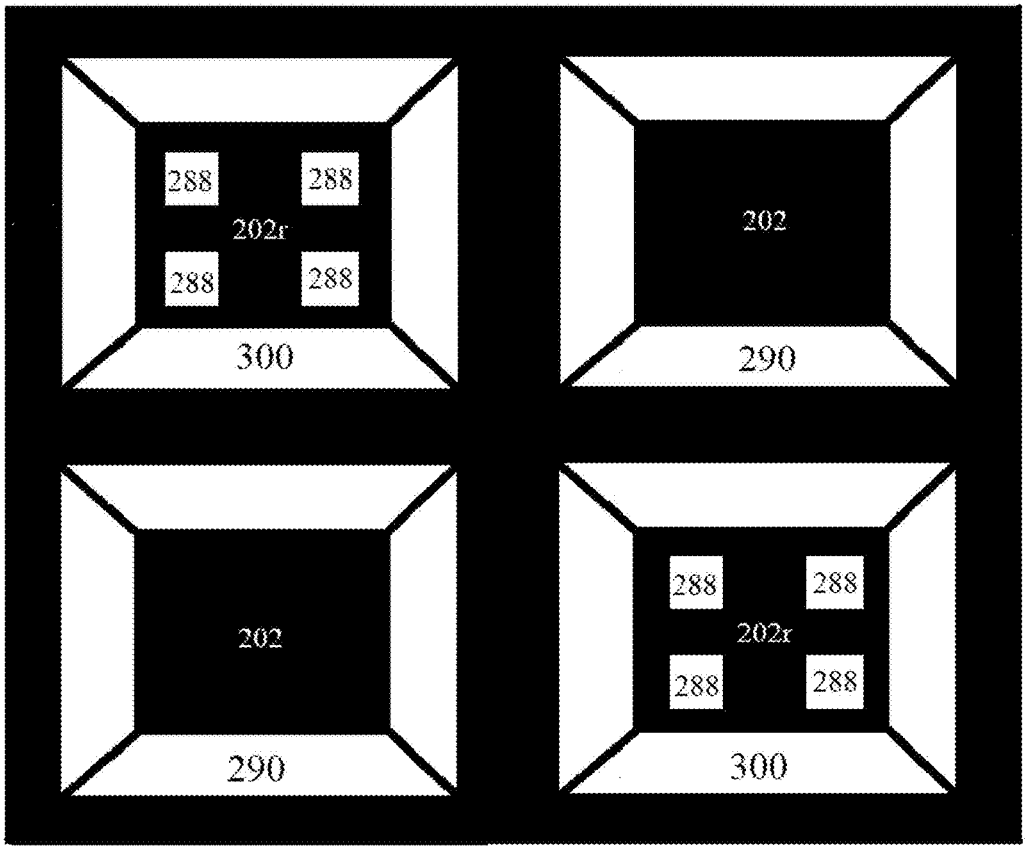
FIG. 8D shows another functional device including two reference membranes and two movable working membranes arranged in a 2×2 array configuration in accordance with an exemplary embodiment of the present invention.

As described in co-pending U.S. application Ser. No. 15/393,831, the movable working membrane 202 may have a shape of square. As shown in FIG. 8A, functional device 290 may include one or more movable working membranes 202. For example, four identical membranes 202 can be arranged in a 2×2 array configuration. According to the present invention, one or two of the four working membranes 202 can be converted into reference membrane(s) 202*r* by fabricating or etching one or more opening(s) 288 thereon, e.g. four square leakage holes 288, for air ventilation. FIG. 8B shows a 2×2 array configuration that includes one reference membrane 202*r* and three working membranes 202 FIG. 8C and FIG. 8D show two 2×2 array configurations that each includes two reference membranes 202*r* and two working membranes 202.

Figure 9:
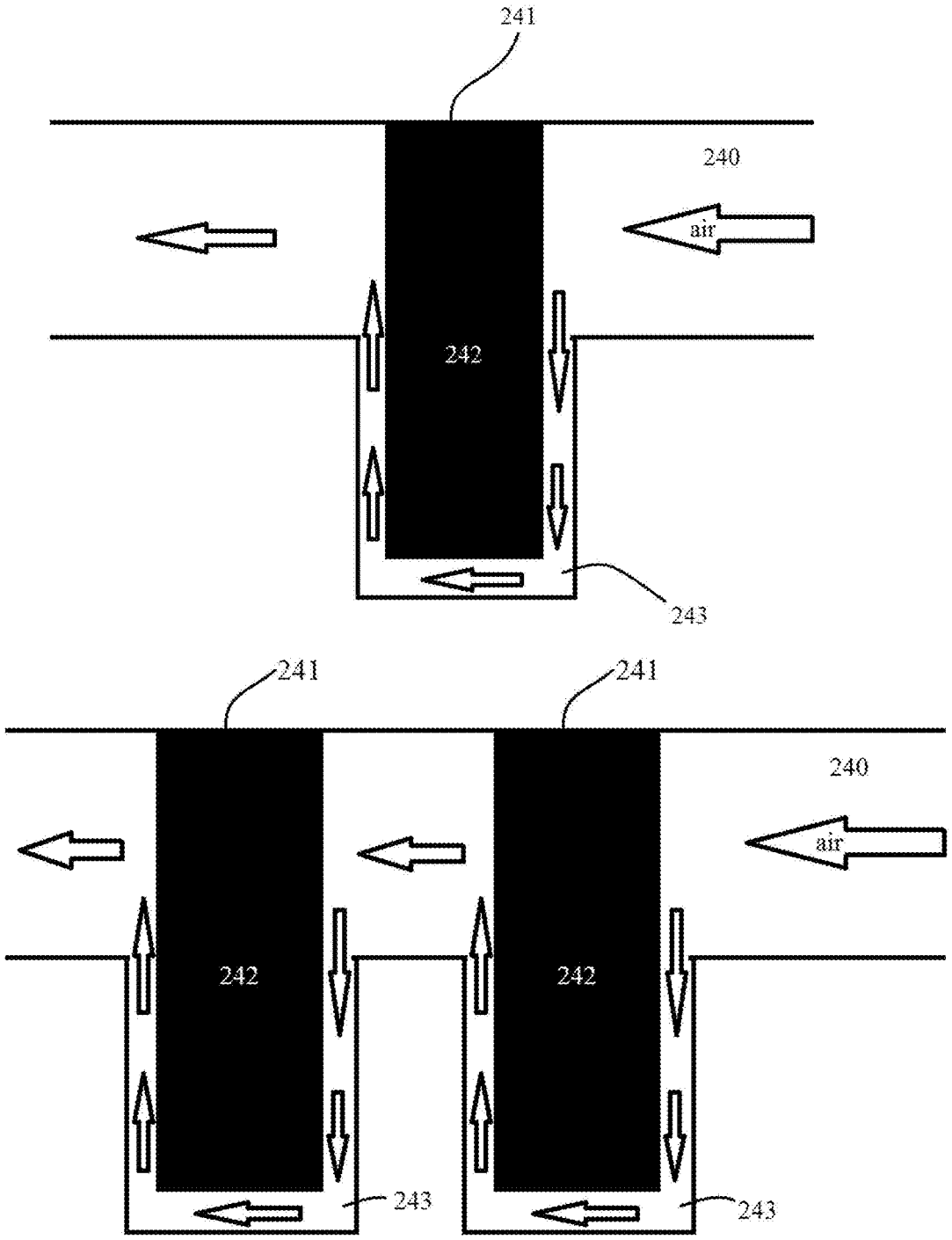
FIG. 9 demonstrates the design of one or more such as two air flow restrictors in accordance with an exemplary embodiment of the present invention.

In some embodiments as shown in FIG. 9, functional device 290 of the invention comprises one or more such as two air flow working restrictors 241 that restrict the flow rate of air that flows in/out of the gap between the working membrane 202 and the substrate 230. Restrictors 241 may be designed to decrease the size of a working air channel 240 for the air to flow in/out of the gap. Alternatively or additionally, restrictors 241 may increase the length of the working air channel 240 for the air to flow in/out of the gap. For example, restrictors 241 may comprise an insert 242 into a groove 243, which not only decreases the size of air channel 240, but also increases the length of the air channel 240. Motional device 300 is identical to functional device 290 regarding restrictors 241/241*r*, air channel 240/240*f*, insert 242/242*r* and groove 243/243*r*, and the description thereof is omitted.

Figure 10:
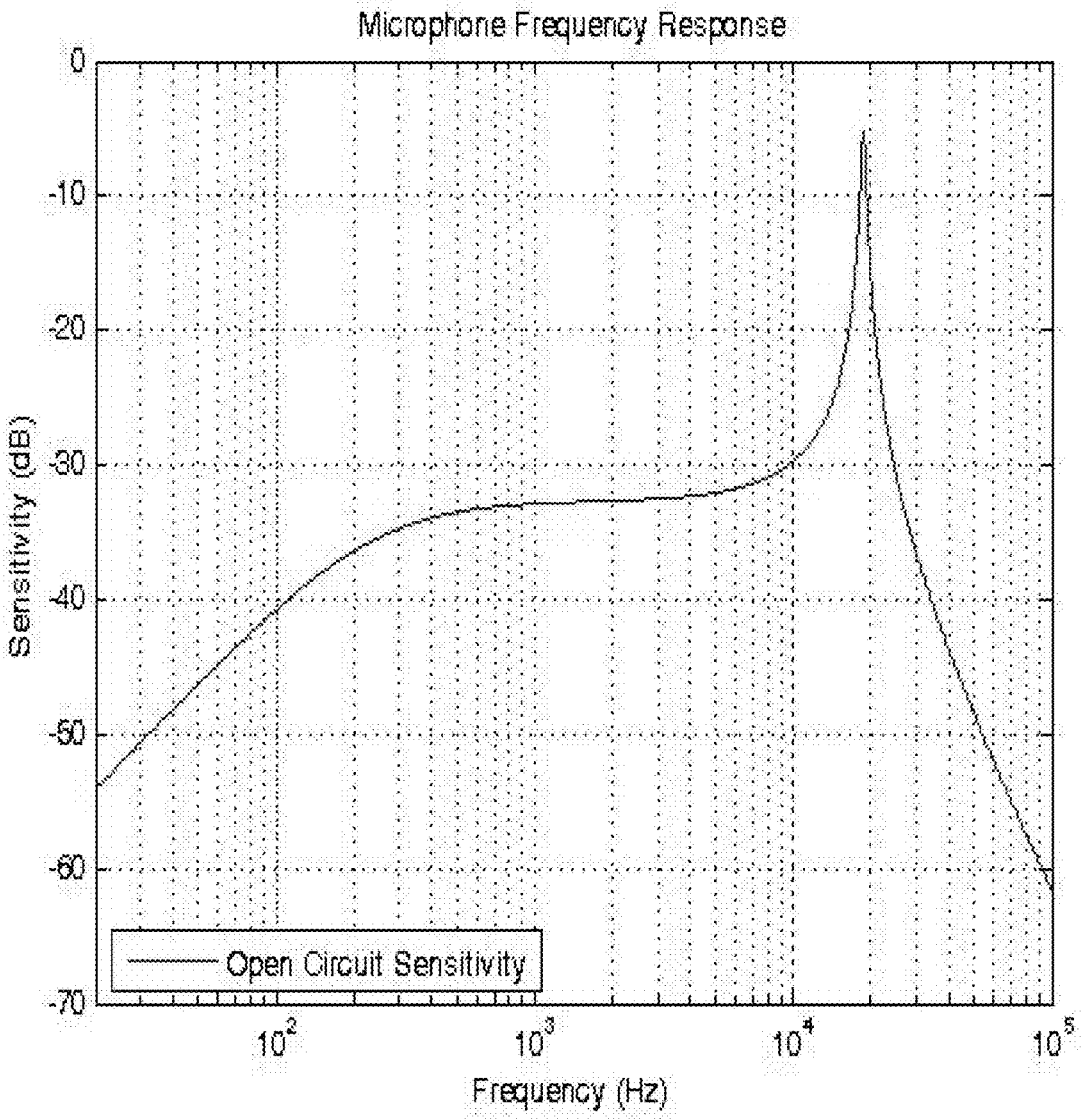
FIG. 10 shows that microphone sensitivity drops at low frequency due to air leakage.

Air flow working restrictors can help solve the leakage problem associated with microphone design. In conventional parallel plate design as shown in FIG. 1A, it typically has a couple of tiny holes around the edge in order to let air go through slowly, to keep air pressure balance on both sides of membrane 101 in low frequency. That is a desired leakage. However, a large leakage is undesired, because it will let some low frequency sound wave escape away from membrane vibration easily via the holes, and will result in a sensitivity drop in low frequency. FIG. 10 shows that sensitivity drops at low frequency due to leakage. For a typical capacitive MEMS microphone, the frequency range is between 100 Hz and 20 kHz, thus the sensitivity drop in FIG. 10 is undesired.

Figure 11:
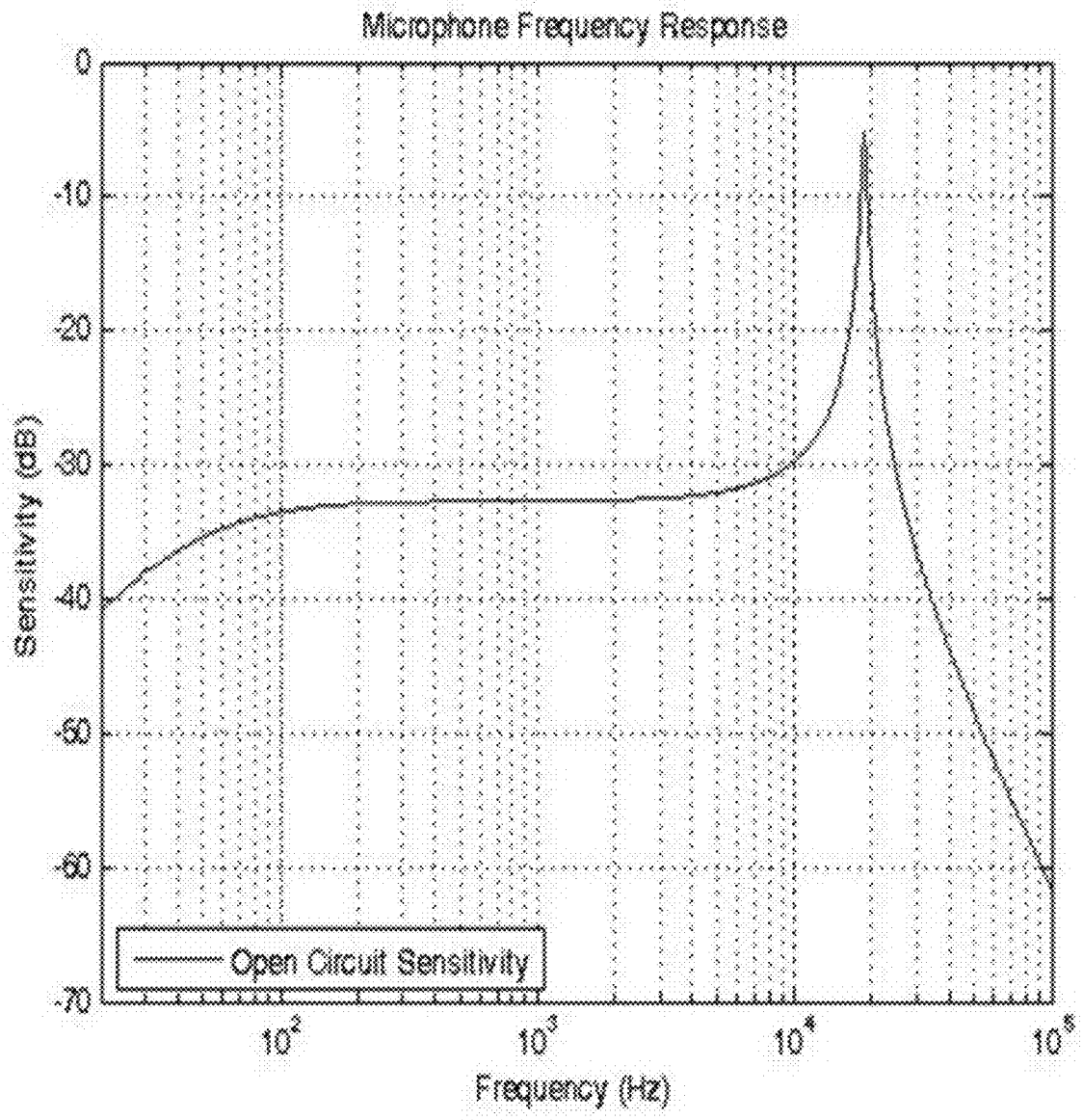
FIG. 11 shows the frequency response with air leakage reduced/prevented in accordance with an exemplary embodiment of the present invention.

In order to prevent this large leakage, a structure is designed and shown in FIG. 9, which illustrates a leakage prevent groove or slot and wall. Referring back to FIG. 9, air flow restrictors 241 may function as a structure for preventing air leakage in the microphone 200 of the invention. Air flow restrictor 241 comprises an insert 242 into a groove 243, which not only decreases the size of an air channel 240, but also increases the length of the air channel 240. In MEMS microphones, a deep slot may be etched on substrate around the edge of square membrane 202 and then a wall 242 connected to membrane 202 is deposited to form a long and narrow air tube 240, which gives a large acoustic resistance. FIG. 11 depicts the frequency response with leakage prevented. This leakage prevention structure has a significant effect on keeping the frequency response plot more flat on the range 100 Hz to 1000 Hz. The level of the air resistance may be controlled by the slot depth etched on the substrate. The deeper slot, the higher the resistance.

In the following, a preferred embodiment of the invention will be analyzed using some theories and modeling. However, it should be understood that the present invention is not limited or bound by any particular theory and modeling.

Figure 12:
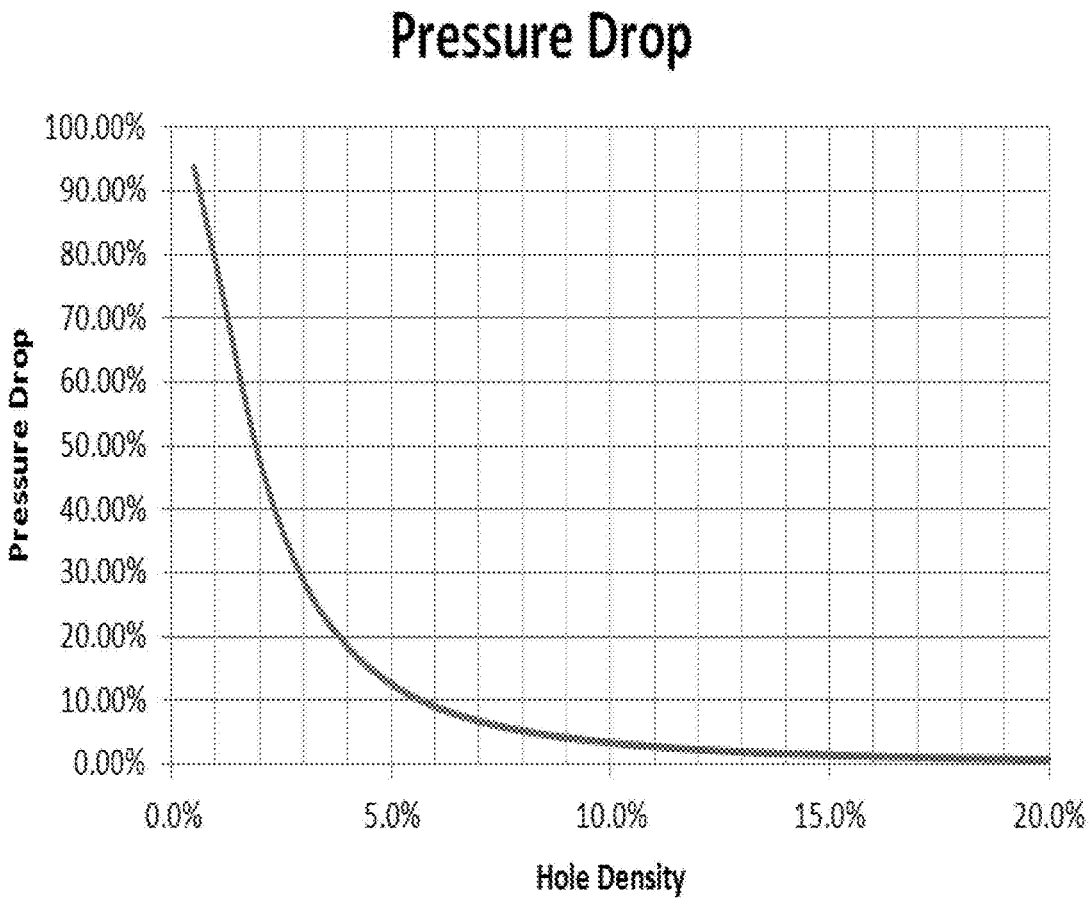
FIG. 12 demonstrates a plot of relationship between Pressure Drop value and hole/opening density on a reference membrane.
Figure 13:
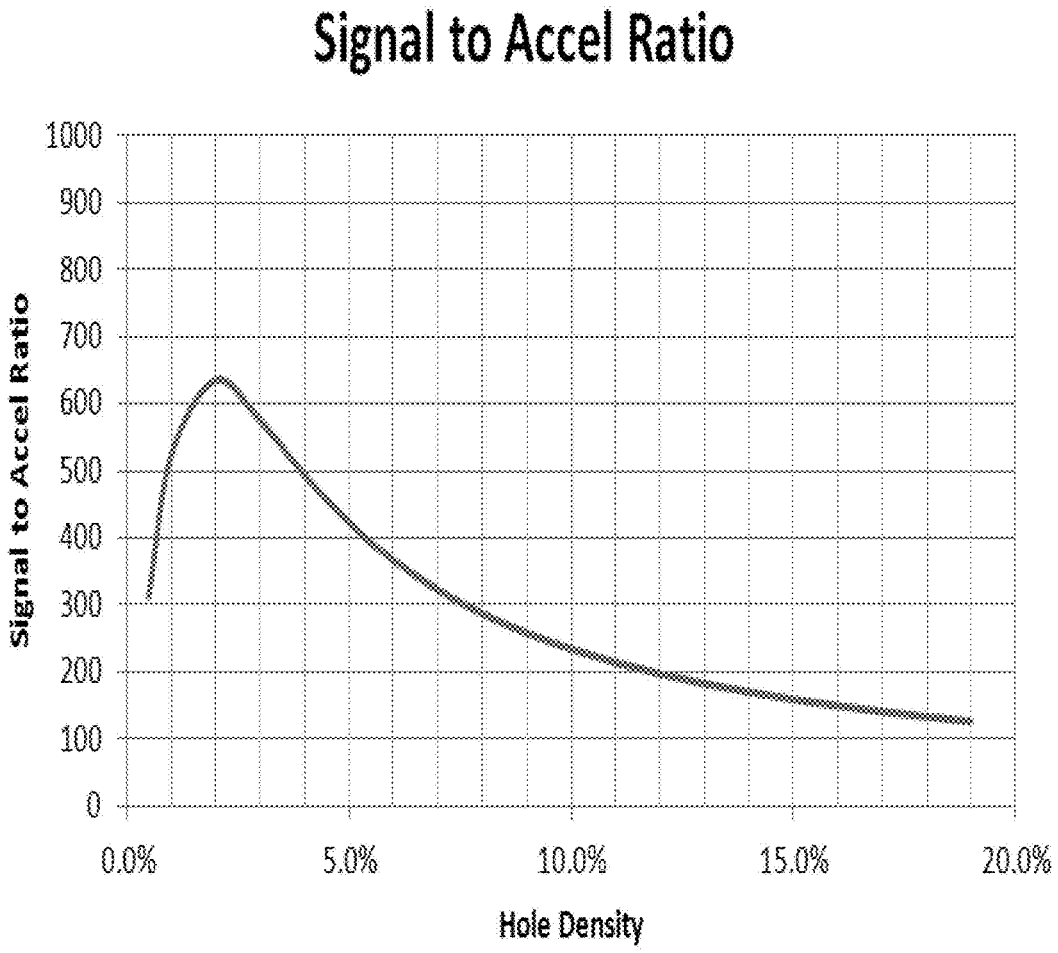
FIG. 13 shows a plot of relationship between Signal to Acceleration Ratio (SAR) value and hole/opening density on a reference membrane.

On reference membrane 202*r* as shown in FIG. 5B, 8B, 8C or 8D, there are 4 holes 288, which lead to a huge leakage of sound pressure between the two sides of membrane 202*r*. A concept of Pressure Drop may be employed to represent pressure difference between two sides of membrane 202*r*. If there is no hole 288 on membrane 202 (functional or working membrane 202), the Pressure Drop value is above 97% (higher value means more sound pressure converted to membrane movement) The larger density, or area ratio, taken by holes 288 on membrane 202*r*, the less Pressure Drop will be, as FIG. 12 shows. When the Pressure Drop value drops near to 0, sound pressure can directly penetrate reference membrane 202*r* through holes/openings 288, and the membrane 202*r* doesn't respond to sound pressure. Then we can fabricate a pair of identical membranes 202 and 202*r* except for holes 288. While working membrane 202 is functional to detect the sum, of sound and acceleration signals Vtotal, reference membrane 202*r* is functional to detect acceleration signal Vms. By canceling the signal coming from acceleration, a corrected output Vct=Vtotal−Vms is obtained. As FIG. 12 and FIG. 13 demonstrate, an opening/hole density of 2% gives a highest SAR value of 635. Even SAR value drops with increasing opening/hole density, it is still larger than 100, which is an acceptable value.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A capacitive microphone comprising a first electrical working conductor, a second electrical working conductor; and a motional sensor;

wherein said two working conductors are configured to have a relative spatial relationship therebetween, and a mutual capacitance exists between said two working conductors, wherein an acoustic pressure impacting upon one or two of said two working conductors along a range of impacting directions in 3D space can cause a variation Va of said mutual capacitance, an acceleration of the capacitive microphone can cause a variation Vm of said mutual capacitance as a noise, and Vtotal=Va+Vm;

wherein said variation Va reaches its maximal value when a given acoustic pressure impacts upon one or two of said two working conductors along one direction among said range of impacting directions, said one direction being defined as the primary working direction;

wherein the first electrical working conductor has a first working projection along said primary working direction on a conceptual working plane that is perpendicular to said primary working direction, and the second electrical working conductor has a second working projection along said primary working direction on the conceptual working plane;

wherein the first working projection and the second working projection have a shortest working distance Dwmin therebetween, and Dwmin remains greater than zero regardless of whether one or two of said two working conductors is (are) impacted by an acoustic pressure along said primary working direction or not;

wherein the motional sensor has a capacitance output Vms, which is used to compensate Vtotal in real-time;

wherein the motional sensor includes a first electrical reference conductor, and a second electrical reference conductor, wherein said two reference conductors are configured to have a relative spatial relationship, therebetween, and a mutual capacitance exists between said two reference conductors;

wherein said acoustic pressure can also impact upon one or two of said two reference conductors along a range of impacting directions in 3D space and can cause a variation Va' of said mutual capacitance, said acceleration of the capacitive microphone can also cause a variation Vm' of said mutual capacitance, and Vms=Va'+Vm';

wherein a corrected output Vct=Vtotal−Vms;

wherein said variation Va' reaches its maximal value when a given acoustic pressure impacts upon one or two of said two reference conductors along one direction among said range of impacting directions, said one direction being defined as the primary reference direction;

wherein the first electrical reference conductor has a first reference projection along said primary reference direction on a conceptual reference plane that is perpendicular to said primary reference direction, and the second electrical reference conductor has a second reference projection along said primary reference direction on the conceptual reference plane;

wherein the first reference projection and the second reference projection have a shortest distance Drmin therebetween, and Drmin remains greater than zero regardless of whether one or two of said two reference conductors is (are) impacted by an acoustic pressure along said primary reference direction or not;

wherein the first electrical working conductor and the first electrical reference conductor are identical, and are fixed relative to a substrate;

wherein the second electrical working conductor comprises a working membrane that is movable relative to the substrate, and said primary working direction is perpendicular to the working membrane plane;

wherein the second electrical reference conductor comprises a reference membrane that is movable relative to the substrate, and said primary reference direction is perpendicular to the reference membrane plane;

wherein the working membrane plane and the reference membrane plane are in parallel with each other;

wherein the second electrical working conductor and the second electrical reference conductor are identical except that the reference membrane has less air resistance than the working membrane;

wherein the reference membrane has one or more openings thereon for air ventilation, but the working membrane does not;

wherein the capacitive microphone further comprises a working air flow restrictor that restricts the flow rate of air that flows in/out of the gap between the working membrane and the substrate, and a reference air flow restrictor that restricts the flow rate of air that flows in/out of the gap between the reference membrane and the substrate; and wherein the working air flow restrictor comprises a working insert into a working trench, and the reference air flow restrictor comprises a reference insert into a reference trench.

2. The capacitive microphone according to claim 1, wherein Va'<20% Va, and 80% Vm<Vm'<Vm.

3. The capacitive microphone according to claim 1, wherein the first electrical working conductor, the second electrical working conductor, the first electrical reference conductor, and the second electrical reference conductor are independently of each other made of polysilicon, gold, silver, nickel, aluminum, copper, chromium, titanium, tungsten, or platinum.

4. The capacitive microphone according to claim 1, wherein the movable working membrane is attached to the substrate via three or more working suspensions such as four working suspensions; the movable reference membrane is attached to the substrate via three or more reference suspensions such as four reference suspensions; and the working suspensions and the reference suspensions are identical.

5. The capacitive microphone according to claim 4, wherein the working suspensions and the reference suspensions each comprises identical folded and symmetrical cantilevers.

6. The capacitive microphone according to claim 1, wherein the first electrical working conductor comprises a first set of working comb fingers, wherein the movable working membrane comprises a second set of working comb fingers around the peripheral region of the working membrane, and wherein the two sets of working comb fingers are interleaved into each other;

wherein the first electrical reference conductor comprises a first set of reference comb fingers, wherein the movable reference membrane comprises a second set of reference comb fingers around the peripheral region of the reference membrane, and wherein the two sets of reference comb fingers are interleaved into each other; and wherein the two sets of working comb fingers and the two sets of reference comb fingers are identical.

7. The capacitive microphone according to claim 6, wherein the second set of working comb fingers are laterally movable relative to the first set of working comb fingers, and the resistance from air located within a gap between the working membrane and the substrate is lowered; and wherein the second set of reference comb fingers are laterally movable relative to the first set of reference comb fingers, and the resistance from air located within a gap between the reference membrane and the substrate is lowered, and is further lowered due to said one or more air vents on the reference membrane.

8. The capacitive microphone according to claim 6, wherein the first set of working comb fingers, the second set of working comb fingers, the first set of reference comb fingers, the second set of reference comb fingers have identical shape and dimension.

9. The capacitive microphone according to claim 8, wherein each working comb finger has a same working width measured along the primary working direction, and the first set of working comb fingers and the second set of working comb fingers have a positional shift along the primary working direction; and each reference comb finger has a reference width same as the working width, measured along the primary reference direction, and the first set of reference comb fingers and the second set of reference comb fingers have a positional shift along the primary reference direction.

10. The capacitive microphone according to claim 9, wherein the positional shift along the primary working direction is one third of said working width; and wherein the positional shift along the primary reference direction is one third of said reference width.

11. The capacitive microphone according to claim 1, wherein the movable working membrane and the movable reference membrane are square shaped.

12. The capacitive microphone according to claim 11, which comprises 3 movable working membranes and one movable reference membrane, or 2 movable working membranes and 2 movable reference membranes, arranged in a 2×2 array configuration.

13. The capacitive microphone according to claim 1, wherein the working air flow restrictor decreases the size of a working air channel for the air to flow in/out of the gap between the working membrane and the substrate, and the reference air flow restrictor decreases the size of a reference air channel for the air to flow in/out of the gap between the reference membrane and the substrate.

14. The capacitive microphone according to claim 1, wherein the working air flow restrictor increases the length of a working air channel for the air to flow in/out of the gap between the working, membrane and the substrate, and the reference air flow restrictor increases the length of a reference air channel for the air to flow in/out of the gap between the reference membrane and the substrate.

* * * * *